United States Patent [19]

Piazza et al.

[11] Patent Number: 4,721,417

[45] Date of Patent: Jan. 26, 1988

[54] COMPLIANT OFFSHORE STRUCTURE STABILIZED BY RESILIENT PILE ASSEMBLIES

[75] Inventors: Michael P. Piazza; Richard H. Gunderson, both of Houston, Tex.; Jerome Q. Burns, San Diego, Calif.; Peter A. Lunde, Houston, Tex.

[73] Assignee: Exxon Production Research Company, Houston, Tex.

[21] Appl. No.: 929,539

[22] Filed: Nov. 10, 1986

[51] Int. Cl.[4] ..... E02B 17/02

[52] U.S. Cl. ..... 405/227; 405/195; 405/224

[58] Field of Search ..... 405/195, 202, 203–205, 405/207, 208, 224–228; 114/264, 265

[56] References Cited

U.S. PATENT DOCUMENTS

| | | | |
|---|---|---|---|
| Re. 32,119 | 4/1986 | Abbott et al. | 405/227 |
| 3,987,636 | 10/1976 | Hruska et al. | 405/227 X |
| 4,117,690 | 10/1978 | Besse | 405/227 |
| 4,363,567 | 12/1982 | Van der Graaf | 405/202 X |
| 4,378,179 | 3/1983 | Hasle | 405/224 X |
| 4,422,806 | 12/1983 | Abbott et al. | 405/227 |
| 4,599,014 | 7/1986 | McGillvray et al. | 405/227 X |

FOREIGN PATENT DOCUMENTS

| | | | |
|---|---|---|---|
| 2123883 | 2/1984 | United Kingdom | 405/227 |

OTHER PUBLICATIONS

Article, "Exxon Study Shows Compliant Pile Tower Cost Benefits," Maus, L. D. et al, Ocean Industry, Mar. 1986, pp. 20–25.

Article, "Compliant Jacket Challenges Deep Water with New Design," McFillivray, T. L. et al., Oil & Gas Journal, May 6, 1985, pp. 112–115.

Advertising Material of Paulstra Industries (a Subsidiary of the Hutchinson Company), "Paulstra Platform Protection System", dated Nov. 1984, pp. 1–14, Plus One Sheet Titled Hefti Hydro-Elastic Fender with Telescopic Interplay for Barge Bumper.

"Control of Seismic Response of Piping Systems and Other Structures by Base Isolation", Report No. UCB-/EERC-81/01, Jan. 1981, published by the College of Engineering, University of California at Berkeley, edited by James M. Kelly.

*Primary Examiner*—Nancy J. Stodola

*Attorney, Agent, or Firm*—Richard F. Phillips

[57] ABSTRACT

A compliant offshore structure in which stabilization against excessive sway is provided by a resilient pile assemblies. A series of drive piles extend into the ocean floor beneath the base of the structure. Drive piles extend upward to a position proximate a pile attachment location on the structure a spaced distance above the ocean floor. The upper end of each drive pile is secured to the structure at the pile attachment location by a resilient coupling. The resilient coupling permits the structure to move upward and downward a slight distance relative to the substantially rigid drive pile. This accommodates sway of the structure. The resilient coupling biases the structure back to a vertical orientation in response to sway of the structure. In a preferred embodiment the pile attachment location is situated proximate the base of the offshore structure.

5 Claims, 13 Drawing Figures

COMPLIANT OFFSHORE STRUCTURE STABILIZED BY RESILIENT PILE ASSEMBLIES

FIELD OF THE INVENTION

The present invention generally concerns piles adapted for supporting offshore structures. More specifically, the present invention concerns a bottom-founded, compliant offshore structure incorporating a number of resilient pile assemblies which provide vertical support and lateral stability to the structure.

BACKGROUND OF THE INVENTION

Most existing offshore oil and gas fields are drilled and produced from rigid structures which rest on the ocean bottom and extend upward to a work deck situated above the ocean surface. A key constraint in the design of such offshore structures concerns limiting the dynamic amplification of the structure's response to waves. Failure to minimize such dynamic amplification will diminish the fatigue life of the structure, and in extreme cases can result in the imposition of excessive loadings on key structural components. Avoidance of dynamic amplification is typically achieved by designing the structure to have rigidity sufficient to ensure that its natural vibrational periods are less than the shortest period of significant enery waves to which the structure will be exposed. For most offshore locations the shortest significant wave period is about seven seconds.

Hydrocarbon drilling and production structures designed in accordance with this approach have proved very satisfactory for most applications in water depths of up to about 300 meters. However, in water depths exceeding 300 meters, the quantity of structural steel required to maintain the fundamental natural vibrational period of a conventional rigid platform below the shortest significant wave period becomes an increasingly strong function of water depth. Because of this, most offshore hydrocarbon reservoirs in water depths much beyond 300 meters cannot be economically produced using a conventional rigid platform.

For deep water applications, it has been proposed to depart from conventional rigid platform design and develop platforms having a fundamental natural period greater than the range of periods of ocean waves containing significant energy. Such platforms, termed "compliant structures," do not rigidly resist waves and other environmental forces, but instead respond compliantly to these forces, undergoing significant lateral motion at the ocean surface either through sway (pivoting of the structure about its base) or bending (flexure of the structure along its length). The use of a compliant offshore structure effectively removes the upper bound on the sway or bending period, thus avoiding the most troublesome design constraint of rigid structures. This greatly reduces the increase in the volume of structural material, and hence cost, required for a given increase in water depth.

Because economic considerations have not yet warranted extensive exploitation of offshore hydrocarbon reserves in water depths greater than about 300 meters, the development of compliant structure technology is currently at a fairly early stage. However, several types of compliant structures have been designed and a few have been constructed and placed in service. One of the most promising concepts for achieving compliancy is incorporated in a proposed structure known as the compliant piled tower. The compliant piled tower is a slender, substantially rigid space-frame tower extending from the ocean floor to a position above the ocean surface. A drilling and production deck is supported atop the tower. Unlike a conventional platform, the tower is not rigidly tied to the ocean floor. This permits the structure to tilt about its base in compliant response to waves, wind, ocean currents and other lateral forces. The tower is stabilized against excessive sway by tubular steel piles which extend upward from positions surrounding the base to a pile attachment position located a preselected elevation above the ocean floor. In response to sway of the tower away from the vertical, the piles establish a righting moment acting at the point of pile attachment. This provides the stabilization necessary to restore the tower to a vertical orientation. One type of a compliant piled tower is detailed in an article at pages 20–25 of the March, 1986 edition of *Ocean Industry magazine.*

A key problem in the development of a practical compliant piled tower centers on the design of the stabilizing piles. As taught in the article cited above, the stabilizing piles are tubular steel elements driven into the ocean floor near the periphery of the tower base and extending upward to a significant elevation above the ocean floor, where they are rigidly secured to the tower. Elastic extension and compression of the tubular steel piles occurs in the course of the tower sway to establish the restoring force necessary to yield the requisite stability. A significant drawback of this arrangement is that it requires a large number of lengthy piles. This significantly increases the weight and cost of the structure. Moreover, in offshore locations combining harsh environmental conditions with relatively shallow water depths, it may not be practical to provide the compliant structure with stabilizing piles long enough to accommodate the necessary extension of the pile without exceeding the safe operating elastic limit of the steel or other material from which they are fabricated.

It would be desirable to develop a pile assembly for compliant piled towers and related offshore structures which provides the necessary compliancy and stabilization while being shorter and less expensive than the compliant pile assemblies proposed heretofore.

SUMMARY OF THE INVENTION

The present invention is directed to a compliant offshore structure having vertical support piles resiliently secured to the platform to accommodate sway of the structure resulting from the forces imposed by waves, wind and ocean currents. In the preferred embodiment the platform includes a space-frame tower extending upward from the ocean floor. The tower extends above the ocean surface to support a work deck. Piles are driven into the ocean floor beneath the tower. These piles extend upward to a pile attachment location on the tower a spaced distance above the ocean floor. The upper end of each pile is secured to the corresponding attachment location on the tower by a resilient coupling. The resilient coupling is adapted to permit the attachment location on the tower to move a limited axial distance relative to the pile. This accommodates tower sway, while providing a restoring force to bias the attachment location to a preselected position relative to the pile. The piles act in conjunction with the resilient couplings to support the weight of the platform and to stabilize the platform against excessive sway.

Though the preferred embodiment of the present invention takes the form of a compliant piled tower, the resiliently coupled piles can be used in conjunction with a variety of other marine structures.

Many advantages are provided by utilizing resiliently coupled piles to support a compliant structure. Existing compliant structures are typically supported by tubular steel piles rigidly secured to the structure. Accordingly, the pile itself must accommodate differential length changes as the portion of the structure to which it is attached moves relative to the ocean bottom. This mandates that the pile have sufficient length above the ocean bottom to accommodate this strain within acceptable stress limits. The present invention avoids need for sizing the piles to accommodate axial platform motion occurring in the course of sway. This greatly diminishes the weight and cost of the piles required.

BRIEF BRIEF DESCRIPTION OF HE BDRAWINGS

For a better understanding of the present invention, reference may be had to the accompanying drawings, in which.

Figure 5A:
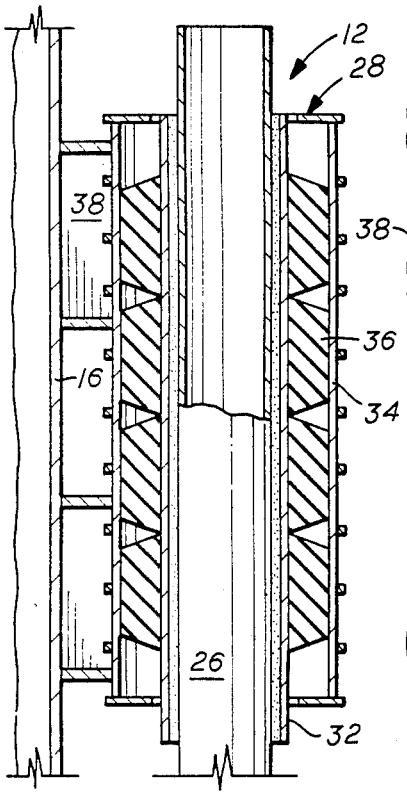
Figure 5B:
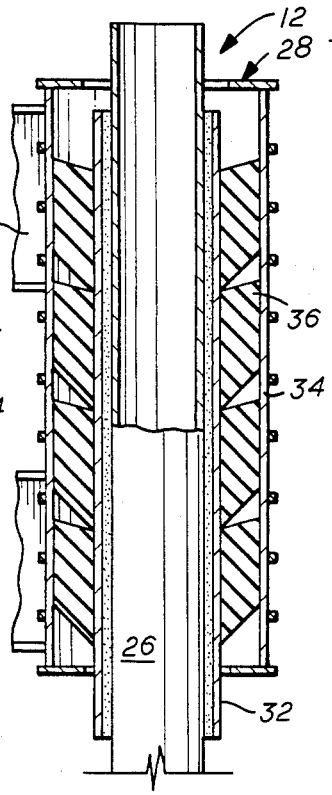
Figure 6:
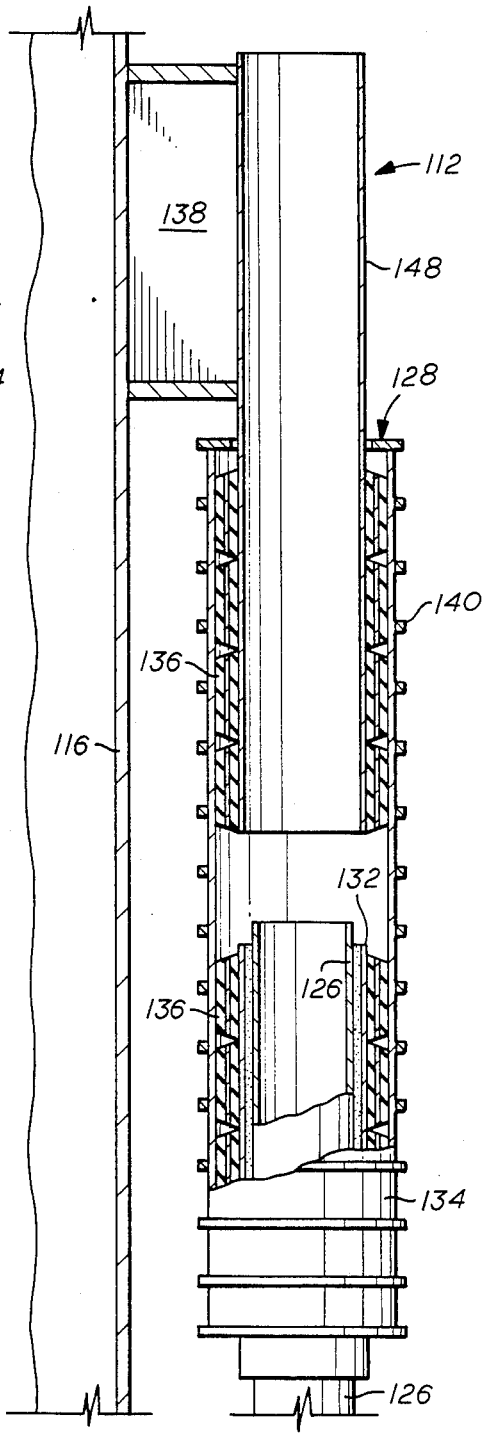
Figure 7:
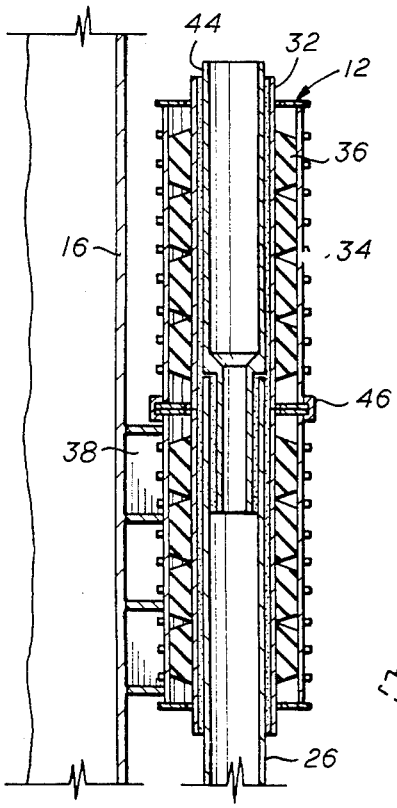
Figure 8:
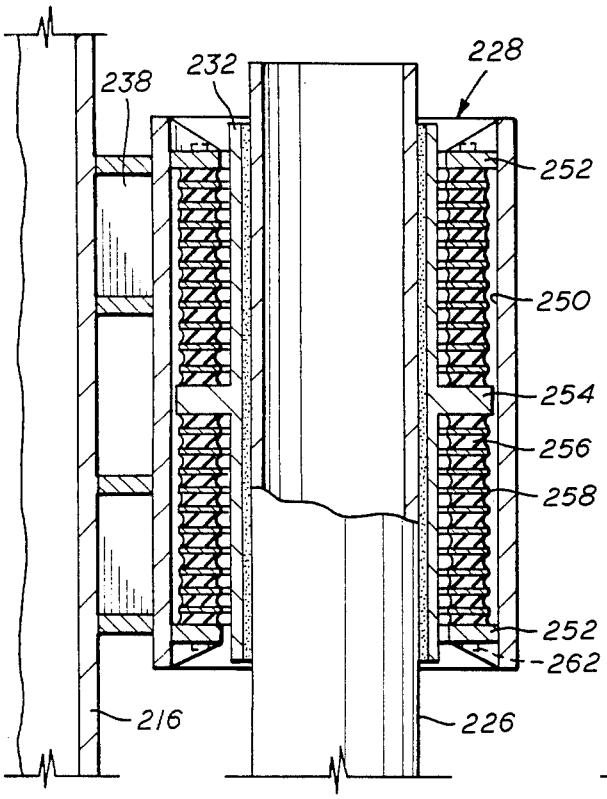
Figure 9:
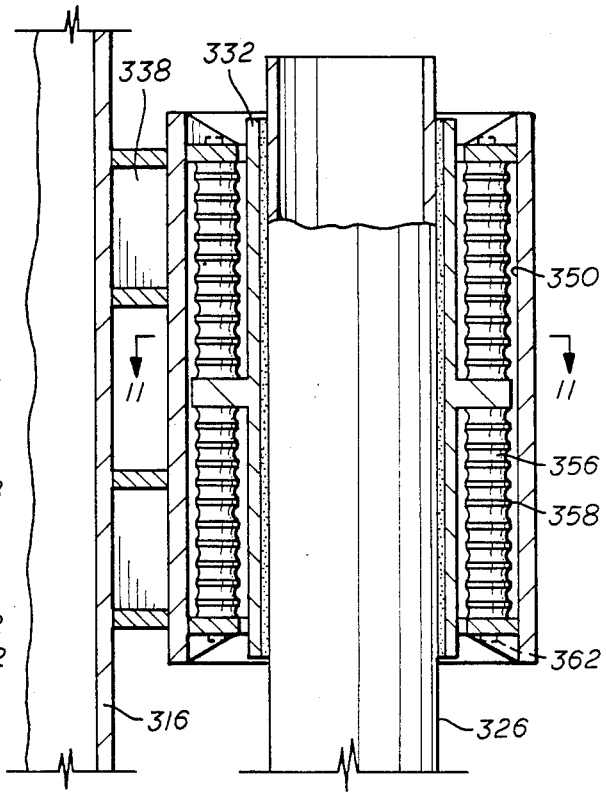
Figure 11:
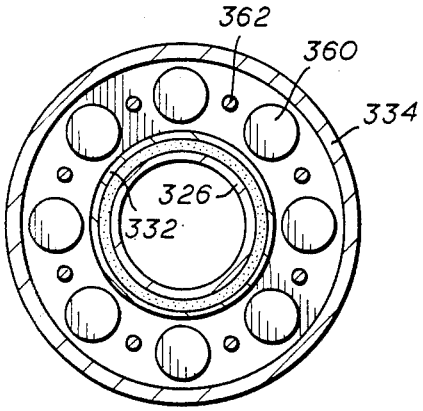
Figure 12:
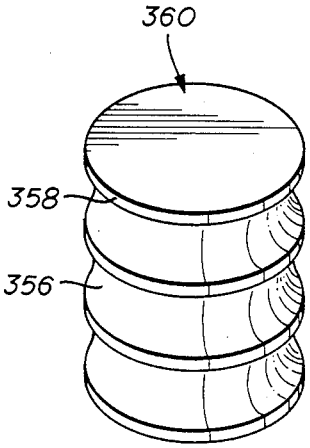
Figure 10:
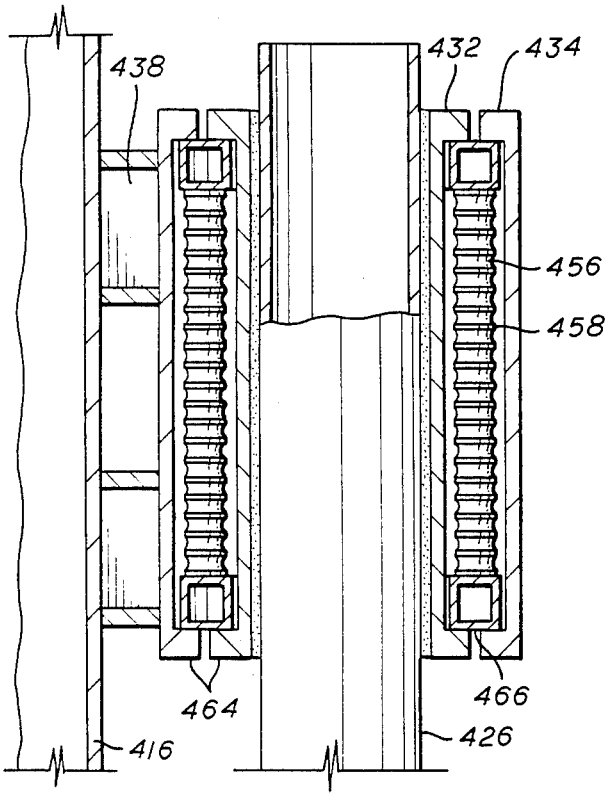

FIGS. 5*a* and 5*b* illustrate the shear deformation of the elastomeric material of the resilient pile assembly as the platform leg to which the pile assembly is attached moves upward in the course of tower sway;

FIG. 6 shows an elevational, partially cut-away cross-section of the upper portion of an alternate embodiment of the resilient coupling;

FIG. 7 illustrates how an additional resilient coupling can be added to a pile assembly after platform installation to replace a failed resilient coupling;

FIG. 8 is an elevational cross-section of an embodiment of a resilient coupling in which the elastomeric elements operate in compression;

FIG. 9 is an elevational cross-section of an alternate embodiment of a resilient coupling in which the elastomeric elements operate in compression;

FIG. 10 is an elevational cross-section of another alternate embodiment of a resilient coupling in which the elastomeric elements operate in compression;

FIG. 11 is a sectional view taken along section line 11—11 of FIGS. 9 and 10; and FIG. 12 is a detail of the elastomeric pads used in the embodiment shown in FIGS. 9 and 10.

These drawings are not intended as a definition of the invention, but are provided solely for the purpose of illustrating certain preferred embodiments of the invention, as described below.

DESCRIPTION OF THE PREFERRED EMBODIMENTS

Figure 1:
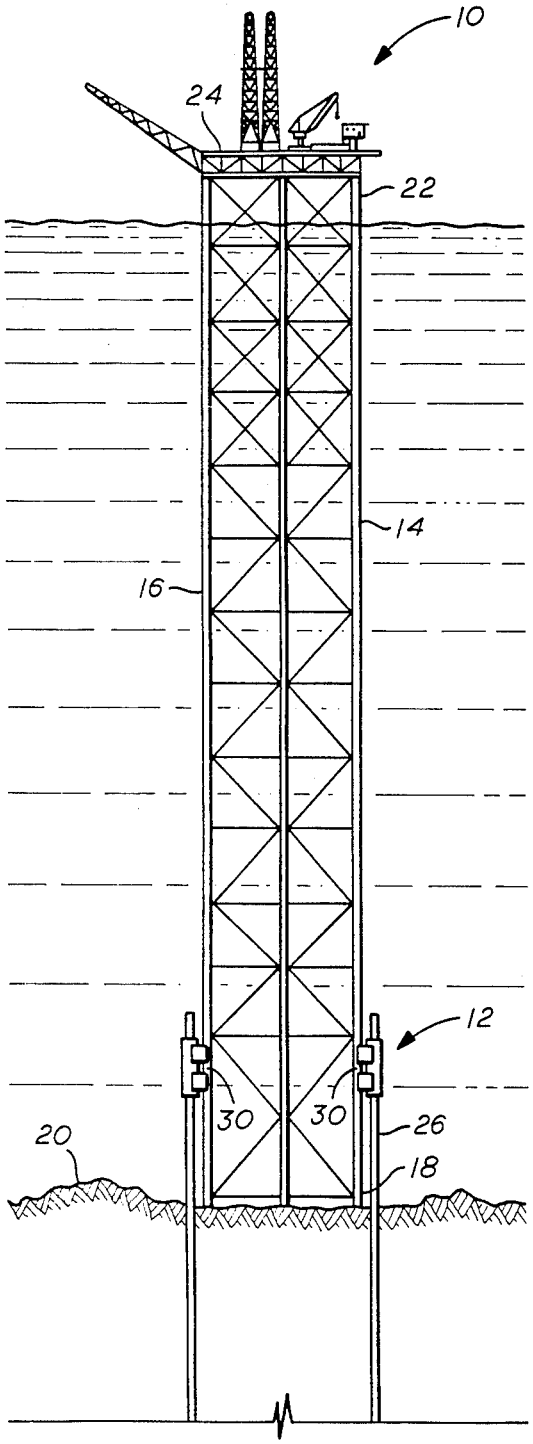
FIG. 1 is an elevational view of a compliant piled tower supported and stabilized by resilient piles.

Illustrated in FIG. 1 is a compliant offshore platform 10 incorporating a preferred embodiment of the present invention. Broadly, the compliant offshore platform 10 of the present invention incorporates a vertical load-bearing structure supported by a plurality of resilient pile assemblies 12. The resilient pile assemblies 12 serve both to support the weight of the structure and to accommodate lateral sway of the structure resulting from lateral forces imposed by waves, wind and ocean currents. As will become apparent in view of the following description, in the preferred embodiment the resilient pile assemblies 12 are especially well suited for use in supporting and stabilizing a specific type of compliant structure known as a compliant piled tower adapted for use in marine hydrocarbon drilling and producing operations. However, the resilient pile assemblies 12 can also be used in conjunction with a variety of other marine structures. To the extent that the following discussion is specific to compliant piled towers, this is by way of illustration rather than limitation.

In the preferred embodiment, a plurality of the resilient pile assemblies 12 are spaced about the perimeter of a rigid space frame tower structure 14 to establish a compliant piled tower 10 for use in offshore oil and gas drilling. The space frame tower 14 is fabricated from steel tubulars in accordance with design and construction procedures well known to those skilled in the art. The tower 14 includes a plurality of vertical legs 16 serving as its primary load bearing members. These legs 16 each extend from a tower base 18 resting on or slightly above the ocean floor 20 to the upper end 22 of the tower 14. A drilling and production deck 24 is seated atop the tower 14 a spaced distance above the ocean surface. The tower 14 is adapted to sway about its base 18 to provide a compliant structural response to waves and other lateral environmental forces.

The resilient pile assemblies 12 serve as the foundation for the tower 14 and deck 24, supporting their combined submerged weight. As more fully detailed below, the resilient pile assemblies 12 are also adapted to permit relative axial motion between any position on the tower 14 and the ocean floor 20. This permits the tower 14 to respond compliantly to lateral environmental forces. Further, the pile assemblies 12 provide a restoring force in response to tower sway, thus stabilizing the tower 14 against excessive lateral motion. The resilient pile assemblies 12 are preferably arranged in groups of 2 to 4 surrounding each of the tower legs 16. However, for the purposes of simplification, the FIGURES show only a single resilient pile assembly 12 associated with each tower leg 16.

Each resilient pile assembly 12 includes two primary components, an elongate pile element 26 rigidly secured to the ocean floor 20 and a resilient coupling 28 for tying the tower 14 to the pile element 26 while permitting limited relative axial movement between the two. In the preferred embodiment, the elongate pile elements 26 are tubular drive piles, configured and installed like the drive piles used to support conventional rigid marine structures. However, the specific configuration and method of installation of the elongate pile elements 26 are not critical to the present invention, provided they serve to firmly anchor the resilient couplings 28 under all anticipated loadings. The pile elements 26 extend upward from the ocean floor 20 to a pile assembly attachment location 30 a spaced distance above the ocean floor 20.

The elevation of the pile assembly attachment location 30 is not critical to the present invention. In many applications, particularly where the structure is to be used in a water depth of less than 450 meters, it will be desirable to situate the pile assembly attachment location 30 relatively near the base of the tower 14, as shown in FIG. 1, This will minimize the length and cost of the pile elements 26. However, in other applications it may be desirable to have the attachment location at or near the deck 24. This facilitates installation, inspection and maintenance of the coupling 28. Additionally, with the coupling 24 situated a significant distance above the ocean floor 20 the free portion of each elongate pile element 26 will undergo compressive and tensile strain, thus accomodating a portion of the sway-induced vertical motion of the pile attachment location 30. This reduces the relative displacement occurring between the tower 14 and the upper end of the pile elements 26, permitting use of a shorter, slimmer coupling 28.

The resilient couplings 28 serve to develop and transmit an axial restoring force from the elongate pile elements 26 to the space frame tower 14 as the tower 14 sways in response to the action of wind, waves, ocean currents and other lateral loadings. Since the resilient pile assemblies 12 are secured to the tower 14 about its perimeter, the restoring forces generated by deformation of the resilient couplings 28 as the tower 14 sways away from the vertical serve in the aggregate to generate a couple which acts at the elevation of the pile attachment locations 30 to restore the tower 14 to a vertical orientation. As will be more fully set forth below, the magnitude of this restoring couple is a function of the magnitude of the tower sway.

Figure 2:
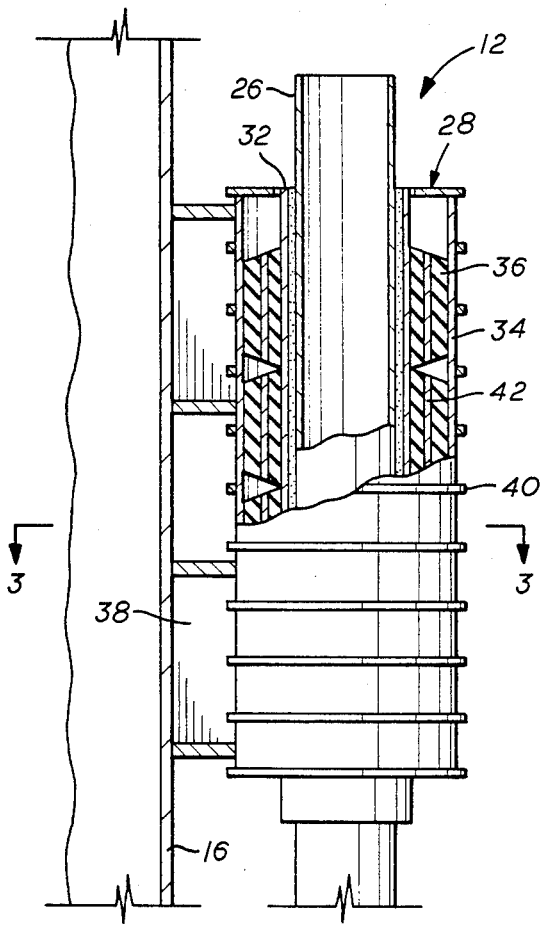
FIG. 2 shows an elevational, cut-away view of the upper portion of the preferred embodiment of the resilient pile assembly.
Figure 3:
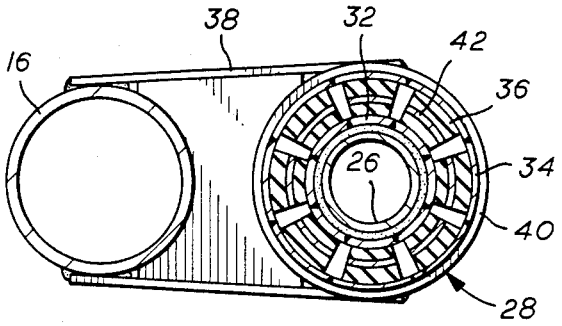
FIG. 3 shows a sectional view taken along section line 3—3 of FIG. 2.

A preferred embodiment of the resilient coupling 28 is illustrated in FIGS. 2 and 3. In the preferred embodiment, the resilient coupling 28 includes an inner sleeve 32, a cylindrical housing 34 concentrically surrounding said sleeve 32, and a group of annularly arranged elastomeric elements 36 interposed between and bonded to the sleeve 32 and housing 34. The housing 34 is rigidly secured to the tower leg 16 by shear plates 38. The sleeve 32 has an inside diameter large enough to receive the corresponding elongate pile element 26, which is rigidly secured thereto by a grouted, welded, mechanical or other connection.

Axial displacement of the housing 34 relative to the sleeve 32, and hence of the tower leg 16 relative to the pile element 26, is accommodated by shearing of the elastomeric elements 36. FIGS. 5A and 5B illustrate the shearing deformation of the elastomeric elements 36 as the tower leg 16 to which a resilient coupling 28 is secured moves upward in the course of tower sway. As the tower leg 16 moves upward or downward relative to the ocean floor 20, the force transferred by the elastomeric elements 36 from the housing 34 to the sleeve 32 changes in a manner which may be defined by the equation $$\Delta F = \frac{2\pi G D \delta (l_i r_i)}{(r_o - r_i)}$$

where $\Delta F$=the change in the axial force applied to the tower leg 16

G=shear modulus of the elastomeric elements 36

D=the fraction of the circumference of the annulus which is occupied by elastomeric elements 36

$\delta$=axial displacement of the housing 34

$l_i$=height of elastomer along the sleeve 32

$r_i$=radius of the outer surface of the sleeve 32

$r_o$=radius of the inner surface of the housing 34

When the tower 14 is in a vertical orientation, the submerged weight of the tower 14 and deck 24 is distributed equally among the piles 26. The housing 34 of each resilient coupling 28 is displaced downward relative to the pile 26 until the resulting shear of the elastomeric elements 36 develops a force which balances the downward load imposed by the tower 14 and deck 24. Sway of the tower 14 occurs about an axis which is perpendicular to the direction of the force resulting in the sway and which passes through the center of rotation of the tower base 18. For most compliant offshore platforms 10, the center of rotation will typically be near the geometric center of the tower base 18. As the tower 14 sways, the tower legs 16 on one side of the sway axis move upward and the tower legs 16 on the opposite side of the sway axis move downward. Because the resilient couplings 28 are under a downward loading when the tower 14 is vertical, tower sway initially reduces the shearing deformation and, hence, the upward force applied by those resilient couplings 28 secured to tower legs 16 moving upward in the course of a sway motion. The resilient couplings 28 on the opposite side of the sway axis are placed under increased shearing deformation and generate an increased upward force. The imbalance in the forces applied by the resilient couplings 28 on opposite sides of the pivot axis establishes a couple which acts to restore the tower 14 to a vertical orientation. By controlling the placement, number and configuration of the resilient pile assemblies 12, the magnitude of the couple for a given tower displacement may be controlled to provide the compliant piled tower 10 with the optimum dynamic response for the environment in which it is situated.

Figure 4:
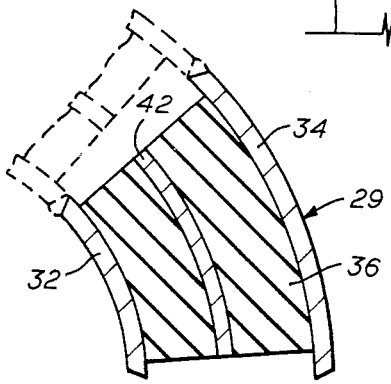
FIG. 4 is a view in horizontal cross section of one of the discrete segments from which the resilient coupling is composed.

Due to the relatively great size and weight of the resilient couplings 28, it is desirable that they be fabricated in arcuate segment 29. This is illustrated in FIG. 4. Each segment 29 includes two curved steel plates, representing corresponding fractions of the total circumference of the sleeve 32 and housing 34, bonded to the corresponding faces of an elastomeric element 36. A group of these segments are welded side-to-side along the axial seams between the sleeve and housing elements to establish a cylindrical coupling module. Ring stiffners 40 are added to the exterior of the housing 34 to provide the necessary bending and torsional stiffness. A series of these modules are then welded end to end to yield the complete resilient coupling 28. As an alternative to the use of arcuate segments 29, the coupling 28 could be composed of flat segments, yielding a polygonal coupling. This somewhat simplifies fabrication.

Fabricating the coupling 28 from a plurality of relatively small segments 29 permits the use of existing equipment for vulcanization of the elastomeric elements 36 and provides greater control over the vulcanization process. In joining the individual segments together, it may be desirable to compress the elastomer prior to welding the individual segments together. This minimizes the incidence of tensile elastomer loadings during operation of the coupling 28, extending its fatigue life.

The elastomeric elements 36 preferably take the form of tapered, arcuate blocks, as shown in FIGS. 3 and 4. Obviously, however, the elastomeric elements 36 could take many alternate forms. We have determined that natural rubber is the best material for the elastomeric elements 36. Natural rubber has a much greater tearing resistance than most synthetic elastomers under both high magnitude static loading and high magnitude cyclical loading, the two dominant loadings to which the elastomeric elements 36 are subjected. A natural rubber desirable for this application would have a moderate hardness (on the order of 60 durometers) and a mid-range, moderate shear modulus (typically 730kPa). This material can accommodate a maximum safe shear strain in the range of from 125% -150%. This strain limit dictates the minimum necessary thickness for the elastomeric elements 36. For example, for a typical compliant structure having a maximum vertical base travel of ±1.00 meters (measured at the base perimeter) under the maximum design loading (typically, the 100-year storm), the required minimum thickness for the elastomeric elements 36 would be in the range of 67 to 80 cm. In some embodiments it will be desirable to provide the elastomeric elements with one or more intermediate stabilizing plates 42 parallel to and intermediate its load bearing surfaces. These serve to improve the shape factor of the elastomeric elements 36. This increases the lateral stiffness of the elastomeric elements 36 and hence stabilizes the sleeve 32 against excessive lateral displacement relative to the housing 34.

Installation of a compliant piled tower 10 utilizing resilient piles 12 is straightforward. The resilient couplings 28 are secured to the tower 14 at pile attachment locations 30 on land during fabrication of the space-frame tower 14. The tower 14 is towed to the offshore installation site and landed on the ocean floor 20 in the conventional manner. Once the tower 14 is resting on the ocean floor 20, a pile element 26 is driven through the sleeve 32 of each of the resilient couplings 28. Once the pile element 26 is driven to the desired depth, it is rigidly secured within the housing 34 by grouting, welding or other suitable manner.

During the life of the compliant piled tower 10 it is possible that one or more of the resilient couplings 28 may weaken or fail. This would most likely occur as a result of tearing or delamination of the elastomeric elements 36. To remedy this problem, a new resilient coupling 28 would be added to the resilient pile assembly 12, as illustrated in FIG. 7. A pin-pile 44, which acts as a dowel, is inserted into the top of the pile element 26 and is rigidly secured thereto by a grouted connection. A replacement resilient coupling 28 is then placed over the pin-pile 44 and rigidly connected thereto, preferably by grouting. The housing 34 of the replacement resilient coupling 28 is then rigidly secured to the housing 34 of the original resilient coupling 28, preferably by a mechanical clamp 46. The relative displacement between the pile element 26 and the tower leg 16 is now transmitted directly to the replacement resilient coupling 28, which generates the required restoring force. To facilitate the addition of new resilient couplings 28 it would be desirable in some applications to utilize pile elements 26 which extend substantially above the original resilient couplings 28, as illustrated in FIG. 1. This permits a replacement coupling 28 to be grouted directly to the pile element 26, eliminating the need for a pin-pile 44.

FIG. 6 shows an alternate embodiment of the present invention in which the resilient coupling 128 takes the form of a double-acting shear spring. The lower portion of the double-acting resilient coupling 128 is generally similar in configuration and function to the single-acting resilient coupling 28 described above. The double-acting resilient coupling 128 differs, however, in that its outer housing 134 extends upward above the sleeve 132 and elongate pile element 126. An upper sleeve 148 is rigidly secured to the tower leg 116 at a pile assembly attachment location 130 above the housing 134 and extends downward into the housing 134. A second set of elastomeric elements 136 establishes a resilient shear coupling between the upper end of the housing 134 and the upper sleeve 148. With this arrangement, the total axial displacement between the pile element 126 and the tower leg 116 is accommodated one-half by the upper elastomeric elements and one-half by the lower elastomeric elements. Accordingly, the thickness of each of the elastomeric elements 136 need be only one-half that required for the single-acting resilient coupling. However, the combined length of the upper and lower sets of elastomeric elements 136 must be twice that of the single-acting resilient coupling to provide an equivalent axial stiffness. Thus, the total volume of elastomeric material required in this embodiment is about the same as that required in the single-acting embodiment. The smaller diameter of the double-acting resilient coupling 128, resulting from the use of thinner elastomeric elements, 136, simplifies tie-in to the tower leg 116.

The resilient pile assembly can assume embodiments in which resiliency is provided by elements other than elastomeric shear springs. For example, it would be possible to substitute elastomeric compression springs for the elastomeric shear springs. Similarly, nonelastomeric resilient elements such as metallic or pneumatic springs could be used. FIG. 8 illustrates an embodiment of the resilient pile assembly in which elastomeric compression springs are used. In this embodiment, the resilient coupling 228 includes a housing 234 rigidly secured to the tower leg 216 at the desired attachment location 230. Concentric with and interior to the housing 234 is a sleeve 232 through which the pile element 226 is driven. The pile element 226 is rigidly secured to the sleeve 232. The sleeve 232 and housing 234 define an annular spring containment space 250 bounded at its upper and lower ends by reaction members 252 fixed to the housing 234. An annular piston 254 secured to the sleeve 232 extends into the spring containment space 250 intermediate the upper and lower reaction members 252. A stack of thin annular elastomeric elements 256 are positioned within the spring containment space 250. The elastomeric elements 256 are separated from one another by thin steel plates 258 to increase the shape factor (that is, the ratio of loaded area to unloaded area) of the elastomeric compression spring thus enhancing its compressive stiffness. Movement of the tower leg 216 upward and downward relative to the pile element 226 results in compression of the lower and upper sets of elastomeric elements 256, respectively, providing the necessary resistive force. A plurality of preload devices 262 (e.g. steel tendons) are used to apply a static compressive preload to the elastomeric element 256.

FICURES 9, 11 and 12 detail another embodiment of a resilient pile aasembly 312 having elastomeric elements acting in compression rather than shear. This embodiment is generally similar to that shown in FIG. 8, but uses a plurality of spaced-apart stacks of elastomeric disks 360 instead of a single stack of annular elastomeric elements as shown in FIG. 8. The cylindrical cross-section of the elastomeric elements employed in this embodiment simplifies fabrication and yields a more efficient use of the elastomer. The stacked elastomeric elements could of course have a non-circular cross-section. For example, it may be desirable te use elastomeric elements which are wedge-shaped in lateral cross-section, like the elements shown in FIGURE 4.

FIGURE 10 shows another embodiment of a resiliant pile assembly 412 having elastomeric elements acting in compression rather than shear. In this embodiment the housing 434 and sleeve 432 each have load element support members 464 at their upper and lower ends extending into the annulus separating the housing 434 and sleeve 432. A load element 466 is positioned at the upper and lower ends of the annulus. Elastomeric disk stacks extend between the upper and lower load elements 466. This arrangement causes all of the elastomeric material to be placed in compression regardless of the direction in which the tower leg 416 moves relative to the pile assembly 412. This provides a more efficient use of the elastomeric material than occurs in the embodiments illustrated in FIGS. 8 and 9. In this embodiment, a single stack of annular elastomeric elements could of course be used in place of an annular array of disk stacks. It is particularly desirable to maintain the elastomeric elements under static compressive preload to offset the effects of creep or relaxation of the elastomer over the life of the coupling 428.

Though the several resilient pile assemblies detailed above have been described only in reference to their use in supporting and stabilizing a compliant piled tower, those skilled in the art will recognize other applications. For example, resilient pile assemblies could be used as vertical support piles for a buoyant or guyed tower.

The preferred embodiment of the present invention and the preferred methods of using it have been detailed above. It should be understand that the foregoing description is intended only to be illustrative, and that numerous other embodiments of the present invention can be developed without departing from the full scope of the invention set forth in the appended claims.

We claim:

1. A compliant offshore platform, comprising:

a vertically extending tower having a bottom end portion proximate the ocean bottom;

a plurality of piles extending upward from the ocean bottom adjacent said tower; and a plurality of resilient coupling elements, each of said coupling elements resliently securing said tower to one of said piles, said coupling elements each including:

a coupling housing defining a vertically extending cylindrical recess;

a first sleeve situated at an upper position within said housing to define an upper annular region intermediate said housing and first sleeve;

a second sleeve situated at a lower position within said housing to define a lower annular region intermediate said housing and second sleeve;

elastomeric material occupying at least a portion of each annular region, said elastomeric material having a radially outer surface supported by said housing and a radially inner face supported by the corresponding one of said sleeves, whereby loads are transferred from said housing to said sleeve through deformation of said elastomeric material; and one of said sleeves being secured to one of said piles and the other of said sleeves being secured to said tower, whereby movment of said tower relative to said pile is resiliently resisted by deformation of said elastomeric material.

2. The compliant offshore platform as set forth in claim 1, wherein said coupling housing, said first sleeve and said second sleeve are all coaxial.

3. The compliant offshore platform as set forth in claim 2, wherein said resilient coupling elements are secured to said tower prior to offshore installation of said tower, said first and second sleeves of each resilient coupling element both being sized to permit the corresponding one of said piles to be driven therethrough.

4. A compliant offshore platform, comprising:

a vertically extending tower having a bottom end portion proximate the ocean bottom;

a plurality of piles extending upward from the ocean bottom adjacent said tower; and a plurality of resilient coupling elements, each of said coupling elements resiliently securing said tower to a corresponding one of said piles, at least one of said coupling elements including:

a first coupling housing defining a vertically extending cylindrical recess, said first coupling housing being secured to said tower;

a first coupling sleeve situated within said first coupling housing to define an annular region, said sleeve being rigidly secured to one of said piles;

at least one first coupling elastomeric shear pad within said annular region, said shear pad having a radially outer face secured to said first coupling housing and a radially inner face secured to said first coupling sleeve;

a second coupling housing defining a vertically extending central recess, said second coupling housing being secured to said first coupling housing;

a second coupling sleeve situated within said second coupling housing to define an annular region, said second sleeve being rigidly secured to said one pile; and at leat one second coupling elastomeric shear pad secured within the annular region defined by said second coupling housing and sleeve, said second coupling shear pad having a radially outer face secured to said second coupling housing and a radially inner face secured to said one pile.

5. The compliant offshore platform as set forth in claim 4, wherein said second coupling housing, said second sleeve and said second coupling shear pad are fabricated as a unit and installed subsequent to installation of said tower.

* * * * *